United States Patent [19]

Röck et al.

[11] Patent Number: 4,465,324

[45] Date of Patent: Aug. 14, 1984

[54] PULL-OUT GUIDE FOR DRAWERS OR THE LIKE

[75] Inventors: Erich Röck; Josef Brunner, both of Höchst, Austria

[73] Assignee: Julius Blum GmbH, Höchst, Austria

[21] Appl. No.: 435,099

[22] Filed: Oct. 18, 1982

[30] Foreign Application Priority Data

Oct. 30, 1981 [AT] Austria ..... 4637/81

[51] Int. Cl.[3] ..... A47B 88/04

[52] U.S. Cl. ..... 308/3.8; 312/341 R

[58] Field of Search ..... 308/3.6, 3.8; 312/330 R, 334, 335, 336, 337, 338, 339, 341 R, 347; 211/151, 162; 248/220.2, 300

[56] References Cited

U.S. PATENT DOCUMENTS

| | | | |
|---|---|---|---|
| 3,362,357 | 1/1968 | Hoffert | 308/3.6 X |
| 3,701,577 | 10/1972 | Fischer | 308/3.6 X |
| 4,367,906 | 1/1983 | Röck | 308/3.8 X |

*Primary Examiner*—Stuart S. Levy
*Assistant Examiner*—David Werner
*Attorney, Agent, or Firm*—Wenderoth, Lind & Ponack

[57] ABSTRACT

A pull-out guide for drawers where each carrier rail consists of two parts, i.e. a fastening member and a runner member. Rollers are held in roller cages which run in the drawer rails. The runner members can be assembled with the fastening members without tools.

7 Claims, 3 Drawing Figures

PULL-OUT GUIDE FOR DRAWERS OR THE LIKE

BACKGROUND OF THE INVENTION

1. Field of the Invention

The invention relates to a pull-out guide for drawers or the like, comprising one pull-out rail on each side of the drawer, a carrier rail on each side of the body and load-transmitting slides or rollers mounted, for example, in a roller cage, the carrier rails being divided in the longitudinal direction into a fastening member and into a runner member, the fastening member adapted to be coupled with the runner member.

2. Description of the Prior Art

Pull-out guides of this type should ensure that extraction and insertion of the drawer in the furniture body is as smooth as possible, and they should further retain the drawer in the body, when the drawer has been partly pulled out from the body, and particularly when the drawer has been pulled out from the body by more than half of its depth.

According to known prior art arrangements, pull-out guides of this type are provided either with slides or rollers. Furthermore, pull-out guides are known in which the rollers are mounted in separate roller cages.

Pieces of furniture are generally transported to the customers in disassembled condition and then assembled. This is particularly true for built-in kitchens or the like.

SUMMARY OF THE INVENTION

It is the object of the invention to provide a pull-out guide of the afore-mentioned type in which the greatest possible number of parts can be preassembled, i.e. at the side-wall of the body as well as at the drawer, which parts are adapted to be stacked and packed in a suitable manner and which allow fast assembling of the piece of furniture.

According to the invention, this is achieved by providing the fastening members and the runner members with positioning pins or the like for positioning the runner members with respect to the depth and breadth of the piece of furniture, such positioning pins extending into holes in the corresponding runner member.

It is advantageously provided that the fastening members as well as the runner members are metal profiles, whereby the fastening members have an L-shaped profile and the runner members a Z-shaped profile.

As the horizontal flange of the fastening member is only very narrow, it hardly impedes stacking of the furniture parts, and hence packing can be done in a very economical manner.

It is further advantageously provided that the positioning pins for the positioning with respect to breadth and depth are at least approximately rectangular and normally arranged adjacent to one another. In order to facilitate positioning of the runner members on the fastening members, the positioning pins are advantageously pointed.

The holes into which the positioning pins extend are preferably slots.

BRIEF DESCRIPTION OF THE DRAWINGS

In the following an embodiment of the invention will be described in greater detail with reference to the accompanying drawings, without being limited thereto, and wherein.

DESCRIPTION OF THE PREFERRED EMBODIMENT

Figure 1:
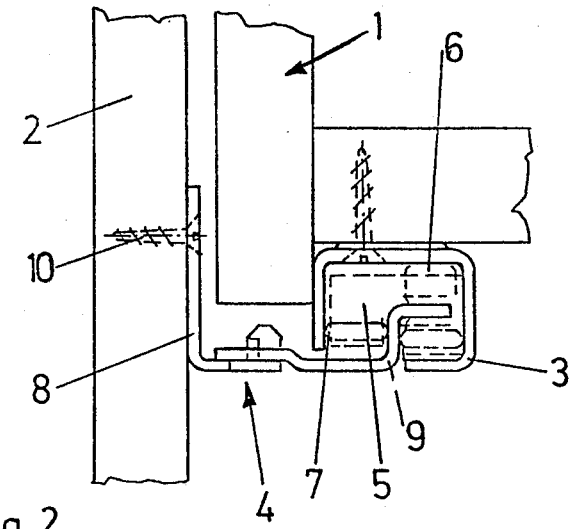
FIG. 1 is a front view of one side of the pull-out guide according to the invention.

In FIG. 1, reference number 1 indicates a drawer and 2 a furniture side wall. A pull-out rail 3 is fastened to the drawer 1 and a carrier rail 4 is fastened to the side wall 2. A roller cage 5 is arranged between the carrier rail 4 and the pull-out rail 3 and runs differentially between such two rails. Rollers 6 and lateral compensating rollers 7 are arranged in the roller cage 5.

According to the invention, the carrier rail 4 comprises a fastening member 8 and a runner member 9, each being an individual member.

The roller cage 5 runs directly on the runner member 9. The fastening member 8 is fastened to the side wall 2 of the body of the article of furniture by means of screws 10.

Figure 2:
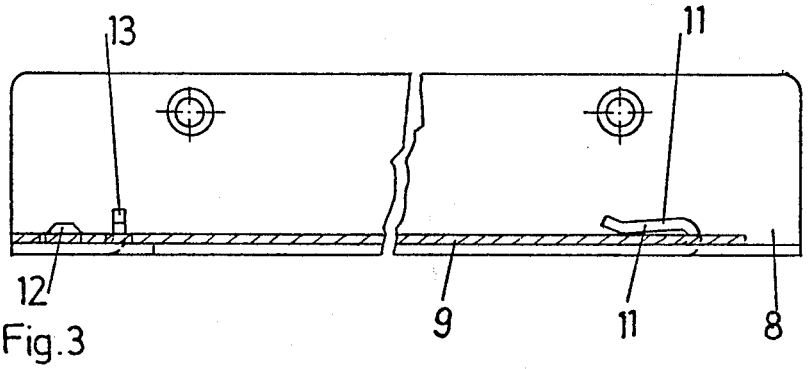
FIG. 2 is a side view of the carrier rail, whereby the region extending into the roller carrier is not illustrated.
Figure 3:
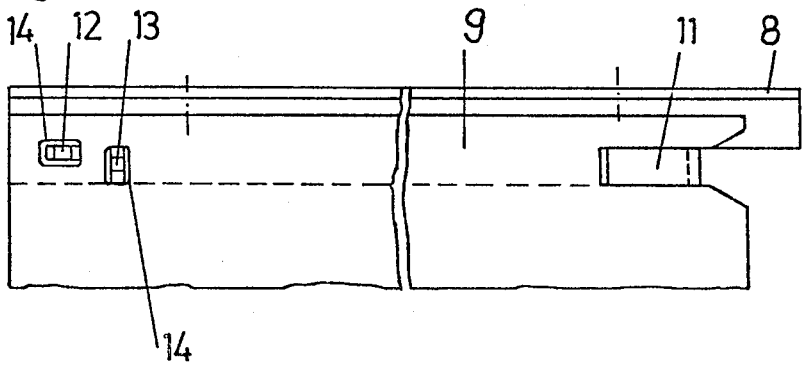
FIG. 3 is a top view of the carrier rail.

As illustrated, the fastening member 8 has an L-shaped profile and is provided with a hook 11 at its horizontal flange, the runner member being inserted into such hook (see particularly FIGS. 2 and 3), e.g. by means of a longitudinal recess. The horizontal flange of the fastening member 8 further has a positioning pin 12 for longitudinal positioning and a positioning pin 13 for lateral positioning of the runner member 9. Positioning pins 12,13 are bent up from the horizontal flange of the fastening member 8 and have, as shown in the drawings, substantially rectangular cross-sections and extend into holes 14 in the runner member 9, which holes also have a rectangular shape. The positioning pins 12,13 are pointed in order to facilitate mounting of the runner member 9.

Although an embodiment comprising a roller cage has been described, the carrier rail arranged on the side of the body and divided according to the invention could equally be applied with a pull-out guide in which the rollers are mounted directly at the rails.

What is claimed is:

1. A pull-out guide assembly adapted to slidably support a side of a drawer to be pulled from and inserted into a furniture body, said assembly comprising:

a longitudinal pull-out rail adapted to be fastened to a respective side of a drawer;

a longitudinal carrier rail adapted to be fastened to a respective side of a body of an article of furniture;

load transmitting means mounted between said pull-out rail and said carrier rail;

said carrier rail comprising a longitudinally extending fastener member adapted to be attached to the body and having a generally L-shaped cross-sectional profile including a horizontal flange, and a longitudinally extending runner member separate from said fastener member and adapted to extend into said pull-out rail between said load transmitting means, said runner member having a generally Z-shaped cross-sectional profile including a horizontal flange; and means for, when assembling the drawer to the body, allowing said runner member to be carried by said load transmitting means and said pull-out rail, and for, when the drawer is assembled to the body, removably attaching said runner member to said fastener member, said means comprising positioning pins extending upwardly from said horizontal flange of said fastener member and holes extending through said horizontal flange of said runner member, said pins extending through said holes with said horizontal flange of said runner member being on top of and overlapping said horizontal flange of said fastener member.

2. An assembly as claimed in claim 1, wherein said pins are bent upwardly from said horizontal flange of said fastener member.

3. An assembly as claimed in claim 1, wherein said pins are of generally rectangular shape and are located adjacent each other.

4. An assembly as claimed in claim 3, wherein said holes comprise slots.

5. An assembly as claimed in claim 4, including a first said slot extending in the longitudinal direction of said fastener member and a second said slot extending transversely of said first slot.

6. An assembly as claimed in claim 1, wherein said fastener and runner members are formed of metal.

7. An assembly as claimed in claim 1, wherein a rear portion of said horizontal flange of said fastener member has an upwardly and forwardly extending hook, and a rear portion of said horizontal flange of said fastener member is fitted into said hook.

* * * * *